United States Patent [19]

Linstromberg

[11] 4,306,379

[45] Dec. 22, 1981

[54] REFRIGERATOR DOOR CONSTRUCTION AND METHOD OF ASSEMBLY

[75] Inventor: William J. Linstromberg, Evansville, Ind.

[73] Assignee: Whirlpool Corporation, Benton Harbor, Mich.

[21] Appl. No.: 125,950

[22] Filed: Feb. 29, 1980

[51] Int. Cl.[3] ..... E06B 7/16

[52] U.S. Cl. ..... 49/486; 49/482; 49/493; 49/501

[58] Field of Search ..... 49/486, 501, 482, 478, 49/493, 487; 312/296; 248/225.2, 243

[56] References Cited

U.S. PATENT DOCUMENTS

| | | | |
|---|---|---|---|
| 2,339,566 | 1/1944 | Goulooze | 49/486 |
| 2,794,219 | 6/1957 | Macklanburg | 49/493 X |
| 2,799,901 | 7/1957 | Jansen | 49/487 |
| 2,807,837 | 10/1957 | Kesling | 49/486 |
| 3,167,821 | 2/1965 | Clark et al. | 49/486 |
| 3,813,815 | 6/1974 | Baermann | 49/482 |
| 3,882,637 | 5/1975 | Lindenschmidt | 49/501 |
| 4,056,211 | 11/1977 | Zumwalt | 49/501 |
| 4,134,626 | 1/1979 | Kordes | 49/487 X |

*Primary Examiner*—Philip C. Kannan

*Attorney, Agent, or Firm*—Wegner, Stellman, McCord, Wood & Dalton

[57] ABSTRACT

A refrigerator door construction and method of assembly wherein an inner door liner and a sealing gasket are secured to the inner surface of the door by a plurality of retainer strips. The retainer strips are provided with locking tabs extending through slots in the door surface and define a plurality of retaining surfaces for positioning the retainer strips selectively in a first, partial installed position and a final fully installed position wherein the retainer strips clamp the edge of the door liner and gasket to the inner door surface. The clamping action is effected by a camming of the retainer strips as a result of movement thereof generally parallel to the door surface. The strips are deflected in the first position to accept the gasket for facilitated installation. Threaded fasteners may be used to secure the retaining strips in the second fully installed position.

17 Claims, 7 Drawing Figures

FIG. 1
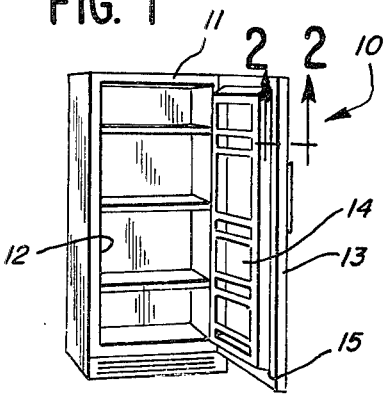
FIG. 3
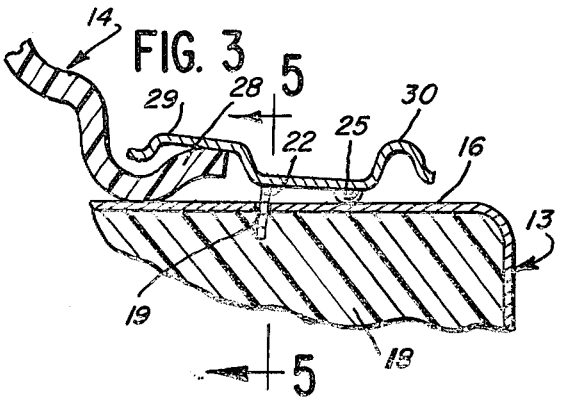
FIG. 4
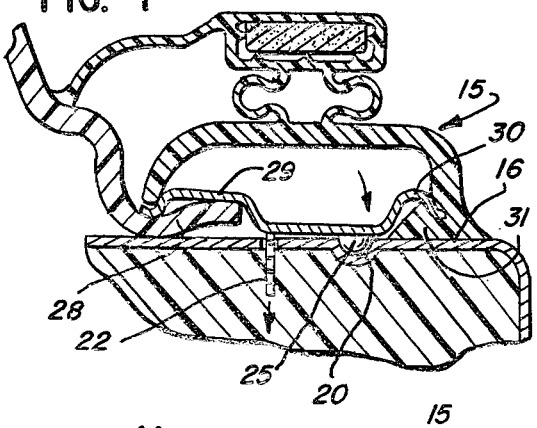
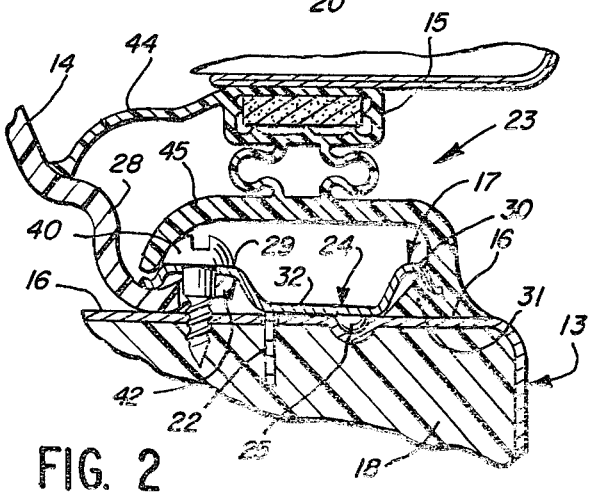
FIG. 2
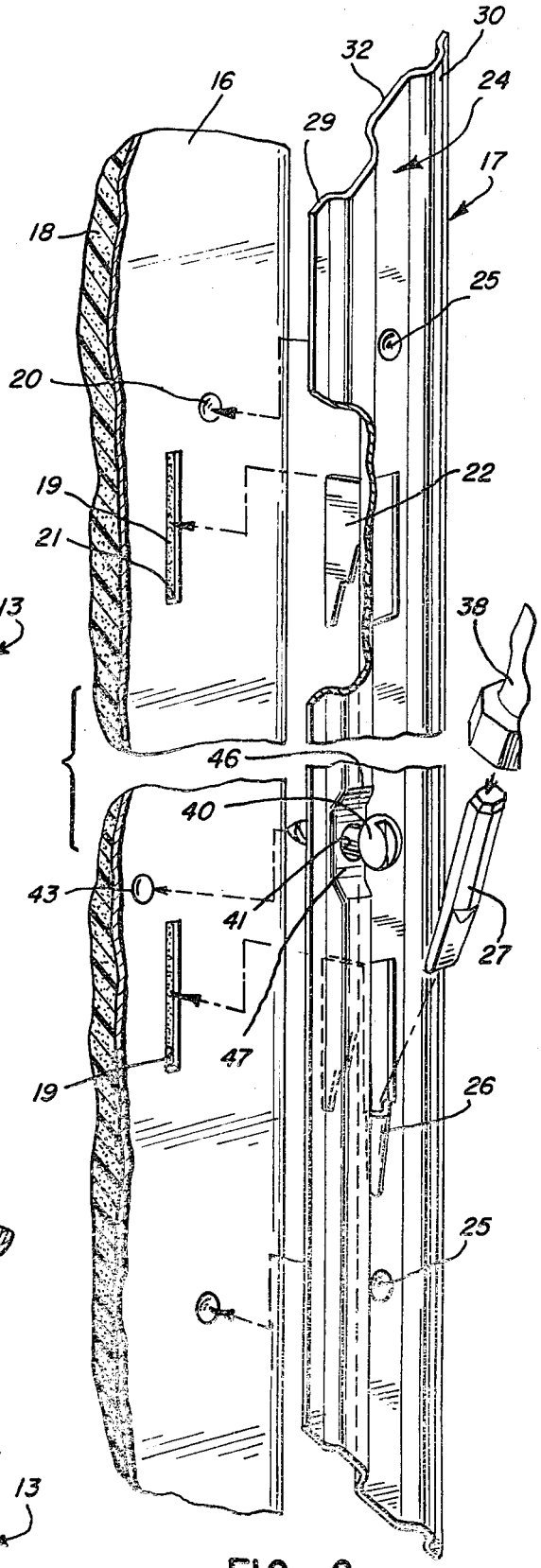
FIG. 6

REFRIGERATOR DOOR CONSTRUCTION AND METHOD OF ASSEMBLY

BACKGROUND OF THE INVENTION

1. Technical Field

This invention relates to door constructions and in particular to means for mounting an inner door structure and a gasket to the inner surface of a refrigerator door or the like.

2. Background Art

In one form of refrigerator door, an inner door panel and gasket are mounted to the inner flange of the door by metal retaining strips. One example of such a door construction is that disclosed in U.S. Pat. No. 3,078,134 of William D. Haynes, Jr. As shown therein, a plurality of spaced-apart screws, bolts or the like are extended through holes provided in the metal clamping pieces and holes in the edges of the inner door panel to be threaded into tapped flared openings of a flange on the outer metal door pan for locking the inner and outer door walls together. The retaining strips further serve to hold the gasket in place.

Another form of seal mounting structure is illustrated in U.S. Pat. No. 3,813,815 of Max Baermann. As shown therein, one of the elements has a plurality of spaced tabs extending outwardly in a row parallel to the edge of the opening. The tabs define a surface facing the first element with some of the tabs having free ends defining a line spaced laterally apart from a line defined by the free ends of the other of the tabs. A body member of the seal is semi-rigid and is snapped over the tabs.

In U.S. Pat. No. 4,134,626, Myron G. Kordes shows a refrigerator door construction wherein the foam material is utilized to secure the assembly. During the filling of the door cavity, spacers are provided within the door so that upon completion of the foaming operation, the spacers may be removed and an anchoring leg of the gasket snapped into place into the cavity left by the removal of the spacers, thereby securing the gasket to the door without the use of screws or other mechanical fasteners.

In U.S. Pat. No. 2,794,219, Louis A. Macklanburg shows a door sealing threshold which utilizes a plurality of tabs projecting through openings in a seal retaining strip. In the embodiment of FIGS. 6 and 7, the retaining strip is driven longitudinally into an interlocking relationship with the tabs.

In U.S. Pat. No. 3,882,637 which patent is owned by the assignee hereof, Robert E. Lindenschmidt discloses a refrigerator door construction wherein the gasket is secured to the door by a portion of a snap-in retaining element. Corner brackets and cross braces may be used to position the liner relative to the outer door structure where the insulation is relatively soft, such as fiberglass insulation.

SUMMARY OF THE INVENTION

The present invention comprehends an improved door construction wherein one or more elements may be secured to a rigid surface panel, such as the inner flange of a refrigerator door. The element retaining means of the present invention comprise a plurality of rigid retainers, each having one or more locking tabs for cooperation with corresponding openings in the door flange. Each locking tab extends through an opening and defines a first retaining surface underlying the flange adjacent the opening in a first, partially installed position for disposing the retainer in slightly spaced relationship to the flange for receiving a portion of the element between the retainer and the flange, and a second retaining surface underlying the flange adjacent the opening in a second, fully installed position for disposing the retainer in a closer spaced relationship to the flange wherein the retainer forcibly clamps the element portion to the flange.

The locking tabs further include a camming surface engageable with the flange portion defining the edge of the opening for camming the retainer to the partially installed and fully installed positions as a result of movement of the retainer transversely to the opening.

The retainers are arranged to have a portion deflected outwardly from the flange in the partially installed position so as to facilitate reception of a portion of the gasket thereunder.

The door construction is arranged so as to permit the retainer to be substantially undeflected in the installed position.

The retainer may be secured in the fully installed position by releasable securing means, such as threaded screws.

The retainer is arranged to loosely retain an inner door liner when the retainer is in the partially installed position, with a gasket clamping portion thereof deflected outwardly about a fulcrum on the retainer engaging the door flange. The fulcrum is brought into a recess in the door flange when the retainer is moved to the fully installed position so as to permit the retainer to become substantially undeflected therein.

The locking tabs may be formed integrally with the retainer and the camming means may be formed integrally therewith. The camming means is adapted to engage the edge of the opening through which the tabs project in the partially installed and fully installed positions.

Shoulder means may be provided on the retaining strips for receiving an applied force to effect the desired movment of the retaining strips and effect the concurrent camming thereof into clamping position relative to the inner door panel and gasket.

Thus, the invention comprehends an improved door construction and method of securing one or more elements in such a door construction. The door construction of the present invention is extremely simple and economical while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a refrigeration apparatus having a door construction embodying the invention;

FIG. 2 is a fragmentary enlarged horizontal section taken substantially along the line 2—2 of FIG. 1, illustrating in greater detail the means embodying the invention for retaining the inner door liner and sealing gasket to the inner surface panel of the refrigerator door;

FIG. 3 is a fragmentary section illustrating a first step in the assembly;

FIG. 4 is a fragmentary section similar to that of FIG. 3 but illustrating a further step in the assembly;

FIG. 6 is a fragmentary perspective view illustrating the association of the retaining strip and door surface panel in greater detail, portions being broken away to facilitate illustration of the invention.

DETAILED DESCRIPTION OF THE INVENTION

Figure 7:
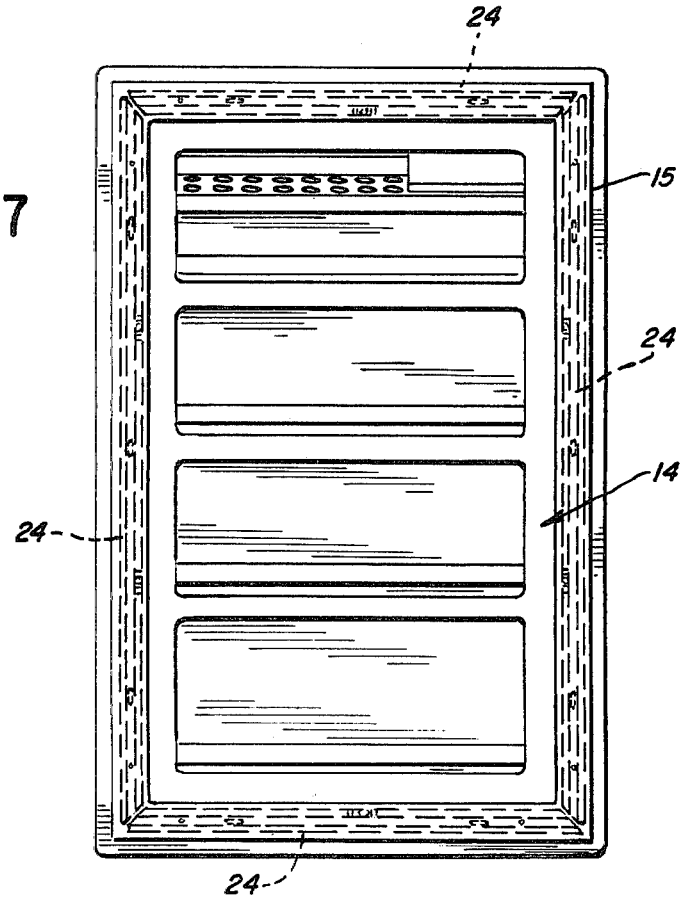
FIG. 7 is an elevation of the door construction utilizing the improved retaining means of the invention.

In the exemplary embodiment of the invention as disclosed in the drawing, a refrigeration apparatus generally designated 10 is illustratively shown to comprise a refrigerator having a cabinet 11 provided with a front opening 12 selectively closed by a door 13. The door carries an inner liner 14 and a peripheral gasket 15 which is retained on the inner flange 16 of the door by a novel retaining means generally designated 17 embodying the invention.

Door 13 may comprise an insulated door having a body of foamed-in-place insulation 18. As best seen in FIG. 6, the flange 16 may be provided with a plurality of slots 19 and a corresponding plurality of semi-spherical depressions or recesses 20. Punched holes could alternatively be used in place of the depressions 20. Each of the slots defines an edge 21 adapted to cooperate with a tab 22 of the retaining means 17 to provide an improved self-locking and clamping action in the door construction 23. As seen in FIGS. 6 and 7, the retaining means 17 comprises a plurality of elongated formed retaining strips 24 having the tabs 22 formed integrally therewith and further being provided with a plurality of dimples 25 functioning as fulcrum means and releasable locking means, as will be brought out more fully hereinafter.

As further illustrated in FIG. 6, each of the retaining strips 24 is provided with an upstanding shoulder portion 26 for receiving an applied force such as from a tool 27 in effecting longitudinal movement of the retaining strip, as also will be brought out more fully hereinafter.

As indicated briefly above, retaining means 17 is provided for retaining the inner door liner 14 and the gasket means 15 on the inner door flange 16. As shown in FIG. 2, the inner door liner 14 includes an outer peripheral portion 28 adapted to be retained against the door flange 16 by an inner portion 29 of the retaining strip 24.

The retaining strip further defines an outer portion 30 adapted to retain an edge portion 31 of the gasket means 15 in clamped association with the flange 16 in the installed arrangement of the retaining means, as illustrated in FIG. 2.

Intermediate the edge portions 29 and 30, the retaining strip 24 is provided with a middle connecting portion 32 carrying the dimples 25 and the tabs 22.

As best seen in FIG. 6, tabs 22 may be formed from the middle portion 32 of the retaining strip by slitting and turning of the tab from the body of the retainer portion 32.

Figure 5:
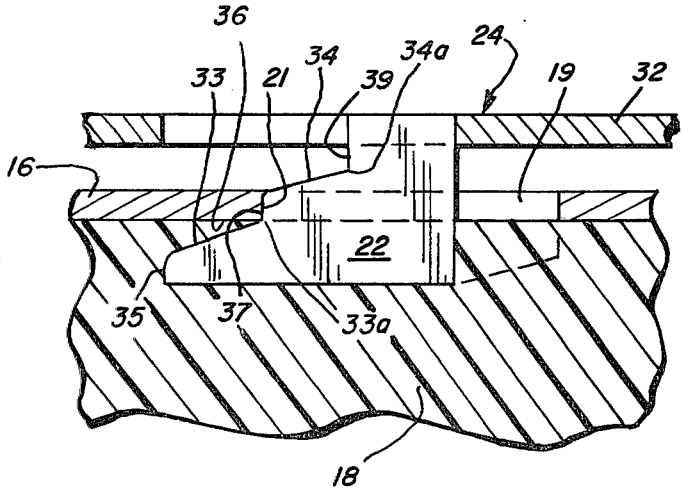
FIG. 5 is a fragmentary section taken along the line 5—5 of FIG. 3.

As best seen in FIG. 5, each tab defines a pair of camming surfaces 33 and 34. The length of tab 22 is preferably less than the length of the slot 19 so that the tab may be pressed upwardly through the slot into the body 18 of insulation, as illustrated in FIG. 3. Once the leading edge 35 of camming surface 33 passes below the inner surface 36 of door flange 16, the retaining strip 24 may be moved longitudinally so as to urge the camming surface 33 against the opening edge 21 of slot 19, thereby camming the tab 22 inwardly into the insulation as a result of the longitudinal movement of the retaining strip 24, as best seen in FIG. 5. Such movement may be readily continued until the slot edge 21 has been moved along camming surface 33 to a first retaining portion **33*a* of tab 22. Retaining portion 33*a* is defined by the junction of cam surface 33 with a stop surface 37, as illustrated in FIG. 5**.

As shown in FIG. 7, the door construction may include four such retainer strips 24 cooperatively defining the retaining means 17. Thus, the entire outer peripheral edge portion 28 of the inner door liner is retained by the inner portion 29 of the strips 24, and the entire length of the sealing gasket portion 31 is retained by the outer portions 30 of the retaining strips.

In effecting such retention, the retaining strips are first brought to a partially installed disposition, such as illustrated in FIG. 3, wherein the liner edge portion 28 is loosely retained by the retaining strip portions 29. The tabs, as illustrated in FIG. 3, are inserted through the slots 19. The retaining strips are then urged longitudinally as by the tool 27 being struck by suitable means, such as hammer 38, to act against shoulders 26 and thereby causing the camming surface 33 to react against slot edge 21, bringing the retaining strips forcibly toward the flange 16 to the position of FIG. 5. In this position, the liner portion 28 is effectively retained by the retaining strip portion 29 while the outer retaining portion 30 is deflected outwardly about the fulcrum defined by the dimples 25 acting against the outer surface of flange 16, as illustrated in FIG. 3. Thus a substantial spacing between the retaining strip portions 30 and the flange 16 is provided for facilitated installation of the gasket portion 31 therebetween while yet the door liner 14 is effectively retained in position on the door 13.

After the sealing gasket 15 is installed with portion 31 thereof disposed between the retaining strip portion 30 and door flange 16, further longitudinal movement of the retaining strips is effected. Thus, the tabs 22 may be urged further into the insulation 18 from the position of FIG. 5 until the camming surface 34 is brought into contact with the edge 21. Longitudinal movment of the retaining strip is then effected by means of tool 27 and hammer 38 acting against shoulder 26 to cam the retaining strip further toward flange 16 until the stop shoulder 39 at the inner end of cam surface 34 abuts the slot edge 21 in the fully installed arrangement of FIG. 4, the edge 21 now resting on a second retaining portion **34*a* of tab 22**.

In this fully installed position, each dimple 25 is received within a corresponding recess 20 of flange 16, thereby removing the deflection of retainer portion 30 and allowing it to clamp the gasket portion 31 sealingly against flange 16, as shown in FIG. 4. Thus, when the dimples are received in the recesses, the deflection action is eliminated and the dimples cooperate with the recesses in defining releasable stop means for preventing longitudinal displacement of the retaining strip from the fully installed position of FIG. 4. However, to provide a further more positive mounting of the door liner 14 to door 13, threaded fasteners 40 may be provided extending through suitable holes 41 in retaining strip portion 32, edge slots 42 in the liner portion 28, and holes 43 in the flange 16. Where the threaded fasteners 40 are utilized, they may be installed by flexing portions 44 and 45 of the gasket 15 sufficiently to provide access to the retaining strip holes 41.

To provide further improved locking of the strips 24 to the flange 16, the strip 24 may be provided with a depressed portion 46 in which the opening 41 is provided with the lower surface thereof being serrated as at 47.

Retaining means 17 of the present invention provides a facilitated installation of the inner door liner and gasket in a refrigerator door or the like. The inner door liner may be retained in proper position in a partially assembled condition of the door structure while the gasket is installed in association therewith. Completion of the makeup of the door construction is readily effected by a simple longitudinal movement of the retaining strips to the final installed position. At that time, one or more screws may be utilized to lock each retaining strip against displacement from the fully installed position.

In the fully installed position, a number of interlock means may be provided, including the cooperating dimple and recess means 25,20 and the retaining screws 40 and serrations 47. The tabs 22 effectively limit the movement of the retaining strips to the desired fully installed position by the provision of the stop shoulders 39 thereon.

As discussed above, the retaining strip means extend fully about the periphery of the inner door liner and the periphery of the sealing gasket. Each of the retaining strips is moved to its final position after the inner door liner portion 28 and gasket portion 31 are suitably positioned inwardly of the clamping portions 29 and 30 thereof. The retaining strips are driven by means of an impact tool to their final fully installed position.

In the assembly of refrigerator doors, the door may be racked, or skewed, to its final position wherein it properly seats against the portion of the cabinet defining the front opening 12. The improved retaining strip securing means permits such racking, and upon completion of this step of the assembly, the retaining strips may be effectively positively secured against displacement from the adjusted position by the locking screws 40, as discussed above.

The inner door liner 14 must be capable of accommodating relatively heavy loads. The improved retaining means of the present invention effectively positively secures the door liner 14 to the refrigerator door 13 and effectively avoids sagging or warping of the door assembly by maintaining a rigid and stiff final installed retaining arrangement.

The dimples 25 cooperate with the cam surfaces 33 on the tabs 22 to provide a deflection of the retaining strips 24 for facilitating the installation of the gasket prior to the use of the dimples as interlocking means cooperating with the recesses 20 of the door panel.

By providing an intermediate stop position, as illustrated in FIG. 5, facilitated adjustment of the peripheral portion 28 of the inner door liner 14 and gasket portion 31 may be effected prior to the final clamped retention. Further, the camming surfaces 34 provide a positive forceful movement of the retaining strips to the clamping position to effect positive clamped retention of the door liner portion 28 and gasket portion 31, as shown in FIG. 2.

The present invention effectively reduces the cost and complexity of assembling such refrigeration apparatus doors. The number of threaded fasteners is effectively minimized and the number of workers necessary to complete the door construction is reduced.

The door construction of the present invention may be readily disassembled, such as for servicing, by simply removing the threaded fasteners and driving the retaining strips 24 in the opposite direction. The use of the thin tabs 22 permits facilitated slicing action in passing into the foamed insulation, while yet assuring easy removal therefrom.

While the invention has been described with reference to a refrigerator door construction wherein it is desirable to secure a liner and gasket to an inner door flange, it will be appreciated that the invention broadly comprehends a means for mounting of one or more elements to a door surface panel.

Having described the invention, the embodiments of the invention in which an exclusive property or privilege is claimed are defined as follows:

1. In a door construction having a rigid surface panel, and an element to be retained to said panel, improved element retaining means comprising:

means defining an opening in said panel; and a rigid retainer having a locking tab extending through said opening and defining a first retaining portion underlying said panel adjacent said opening in a first, partially installed position and means cooperating with said first retaining portion for disposing said retainer in slightly spaced relationship to said panel for receiving a portion of said element between said retainer and said panel, said retainer further defining a second retaining portion underlying said panel adjacent said opening in a second, fully installed position wherein said retainer is disposed in a closer spaced relationship to said panel wherein said retainer forcibly clamps said element portion to said panel.

2. The door construction of claim 1 wherein said locking tab further includes a camming surface engageable with said panel portion defining said opening for camming said retainer from said slightly spaced position to said closer spaced position as a result of movement of said retainer along said door panel.

3. The door construction of claim 1 further including means for releasably retaining said retainer in said second position.

4. The door construction of claim 1 wherein a second element to be retained is clamped to said panel by said retainer concurrently with said first named element.

5. In a refrigerator door construction having a rigid inner surface panel, an inner door liner and a gasket to be retained to said panel, improved retaining means comprising:

means defining an opening in said panel; and a rigid retainer having a locking tab extending through said opening and defining a first retaining portion underlying said panel adjacent said opening in a first, partially installed position and means cooperating with said first retaining portion for disposing a first clamping portion of said retainer in slightly spaced relationship to said panel for receiving a portion of said door liner between said retainer and said panel and disposing a second clamping portion of said retainer in slightly spaced relationship to said panel for receiving a portion of said gasket between said retainer and said panel adjacent said opening in a second, fully installed position wherein said retainer is disposed in a closer spaced relationship to said panel wherein said retainer forcibly clamps each of said door liner and gasket to said panel.

6. The door construction of claim 5 wherein said locking tab further includes a camming surface engageable with said panel portion defining an edge of said opening for camming said retainer from said first position to said second position as a result of movement of said retainer along said panel.

7. The door construction of claim 5 wherein said door liner portion is retained by said first clamping portion of the retainer and said second portion of the retainer is spaced from the panel to receive said gasket portion when said retainer is in said first position.

8. The door construction of claim 5 wherein said retainer comprises an elongated metal element and said locking tab is formed integrally therewith.

9. The door construction of claim 5 wherein said opening comprises a slot and said locking tab comprises a thin tab freely receivable in said slot.

10. The door construction of claim 5 wherein said door panel defines a rectangular periphery and said door construction includes at least four said retainers for clamping said gasket and door liner along each of the edge portions of the rectangular periphery.

11. The door construction of claim 5 wherein removable locking means are provided for locking the retainer in said second position.

12. The door construction of claim 5 wherein said locking tab further includes a caming surface engageable with said panel portion defining an edge of said opening for camming said retainer from said first position to said second position as a result of movement of said retainer along said panel and shoulder means are provided on said retainer for reacting to an applied force to so move said retainer.

13. The door construction of claim 6 wherein said means cooperating with said first retaining portion comprises a fulcrum means engaging said panel in said first position to deflect said second clamping portion away from said panel, said panel defining a recess for receiving said fulcrum means in said second position of said retainer.

14. The door construction of claim 13 wherein said fulcrum means comprises a struck hemispherical protrusion on said retainer.

15. In a refrigerator door construction having an inner surface panel, an inner door liner, a gasket, and a retainer strip having an inner edge portion for clamping said liner to said panel and an outer edge portion for clamping said gasket to said panel, the improvement comprising:

means on said inner surface panel defining an opening;

a locking tab carried by said retainer and extending through said opening in said inner surface panel, said opening and said tab being arranged to permit sliding movement of said retainer along said panel toward a fully installed position;

spacing means carried by said retainer and extending into engagement with said inner surface panel, said spacing means being disposed in closer proximity to said outer retainer edge portion than said locking tab; and recess means on said inner surface panel positioned to receive said spacing means when said retainer has been moved to its fully installed position.

16. In a refrigerator door construction having an inner door flange and a door liner including a peripheral edge portion extending along said door flange, an improved retaining means comprising:

means defining a plurality of slots in said door flange adjacent said liner edge portion, said slots having a length extending in a direction generally parallel to said liner edge portion; and a retainer strip having a portion overlying and extending along said liner edge portion, said retainer strip further including a plurality of locking tabs each of which extends through a respective one of said slots, at least one of said locking tabs including a cam surface for engaging an edge portion of the slot and camming said retainer downward toward said door flange upon movement of said retainer along a line generally parallel to said liner edge portion toward a fully installed position, and at least one of said locking tabs including stop means for loosely retaining said retainer in a partially installed position.

17. In a door construction having a rigid surface panel, an element to be retained in said panel, and a retaining strip having a portion engageable with said element for securing said element to said panel, the improvement comprising:

means defining an opening on one of said panel and said retaining strip;

means defining a two-position locking tab on the other one of said panel and retaining strip, said locking tab extending through said opening and defining a first retaining surface for temporarily retaining said retaining strip in a first, partially installed position; and means on said retaining strip and panel cooperating with said first retaining surface for disposing said retaining strip portion in slightly spaced relationship to said panel for loosely retaining said element in association with said panel, said locking tab further defining a second retaining surface for retaining said retaining strip in a second, fully installed position wherein said retaining strip portion is urged firmly against said element for clamping said element to said panel.

* * * * *

UNITED STATES PATENT AND TRADEMARK OFFICE

CERTIFICATE OF CORRECTION

PATENT NO. 4,306,379

DATED December 22, 1981

INVENTOR(S) William J. Linstromberg

It is certified that error appears in the above-identified patent and that said Letters Patent are hereby corrected as shown below:

Claim 13, line 1 (col. 7, line 34), after "claim" cancel "6" and substitute therefor --5--.

Signed and Sealed this

*Twenty-second* Day of *June 1982*

[SEAL]

*Attest:*

GERALD J. MOSSINGHOFF

*Attesting Officer*

*Commissioner of Patents and Trademarks*